US007746276B2

(12) United States Patent
Surducan et al.

(10) Patent No.: US 7,746,276 B2
(45) Date of Patent: Jun. 29, 2010

(54) MICROSTRIP MULTI-BAND COMPOSITE ANTENNA

(75) Inventors: Emanoil Surducan, Cluj-Napoca (RO); Daniel Iancu, Pleasantville, NY (US); John Glossner, Carmel, NY (US)

(73) Assignee: Sandbridge Technologies, Inc., White Plains, NY (US)

( * ) Notice: Subject to any disclaimer, the term of this patent is extended or adjusted under 35 U.S.C. 154(b) by 514 days.

(21) Appl. No.: 11/719,246

(22) PCT Filed: Feb. 2, 2006

(86) PCT No.: PCT/US2006/003564

§ 371 (c)(1),
(2), (4) Date: May 14, 2007

(87) PCT Pub. No.: WO2006/086194

PCT Pub. Date: Aug. 17, 2006

(65) Prior Publication Data

US 2009/0079658 A1 Mar. 26, 2009

(51) Int. Cl.
*H01Q 1/38* (2006.01)

(52) U.S. Cl. ..... 343/700 MS

(58) Field of Classification Search ..... 343/700 MS, 343/702; 333/132–133, 12
See application file for complete search history.

(56) References Cited

U.S. PATENT DOCUMENTS

| | | | | |
|---|---|---|---|---|
| 5,554,960 | A * | 9/1996 | Ohnuki et al. | 333/132 |
| 6,326,863 | B1 * | 12/2001 | Kushitani et al. | 333/128 |
| 6,608,534 | B2 * | 8/2003 | Kushitani et al. | 333/126 |
| 6,781,479 | B2 * | 8/2004 | Ikada et al. | 333/133 |
| 6,788,164 | B2 * | 9/2004 | Maekawa et al. | 333/26 |
| 7,026,887 | B2 * | 4/2006 | Watanabe et al. | 333/126 |
| 2001/0038325 | A1 | 11/2001 | Smith et al. | |
| 2002/0027482 | A1 * | 3/2002 | Kushitani et al. | 333/126 |
| 2003/0011439 | A1 * | 1/2003 | Kawanami | 333/24.2 |
| 2004/0041660 | A1 * | 3/2004 | Kawahara et al. | 333/133 |
| 2006/0055602 | A1 | 3/2006 | Huber et al. | |
| 2007/0085108 | A1 * | 4/2007 | White et al. | 257/173 |

FOREIGN PATENT DOCUMENTS

| | | | |
|---|---|---|---|
| EP | 0 871 238 | A | 10/1998 |
| EP | 1487051 | A1 | 12/2004 |
| GB | 2 340 309 | A | 2/2000 |
| WO | 03/034545 | A1 | 4/2003 |
| WO | WO 03/044897 | A | 5/2003 |
| WO | WO 2004/070875 | A | 8/2004 |
| WO | 2004/077610 | A1 | 9/2004 |

OTHER PUBLICATIONS

Extended European search report; dated Oct. 9, 2008 for European Application No. 0672088.1.
Surducan E, et al.; "Modified Printed Dipole Antennas for Wireless Multi-Band Communication Devices" URSI 2004 Int'l Symposium on Electromagnetic Theory; vol. 2, May 23, 2004.
Anguera J, et al.; "Multifrequency Microstrip Patch Antenna Using Multiple Stacked Elements"; IEEE Microwave and Wireless Components Letters; vol. 13, No. 3, Mar. 1, 2003.

* cited by examiner

*Primary Examiner*—Huedung Mancuso
(74) *Attorney, Agent, or Firm*—Barnes & Thornburg LLP

(57) ABSTRACT

The multi-band antenna structure includes a first antenna having a band width about a middle frequency and a second antenna spaced and electrically isolated from the antenna. Ends of the second antenna are shorted to each other and the antenna floats electrically. The first and second antennas are planar and superimposed in parallel planes. At least two layers of dielectric material of a thickness is between the two antennas. A third layer of dielectric material of a third thickness is between the two antennas.

20 Claims, 3 Drawing Sheets

MICROSTRIP MULTI-BAND COMPOSITE ANTENNA

BACKGROUND AND SUMMARY OF THE DISCLOSURE

The present disclosure is directed generally to a composite antenna structure having the ability to receive or transmit on multiple frequency bands, and more specifically to a composite antenna structure to receive low as well as high frequencies, for example, Digital Video Broadcasting (DVB), analog TV as well as Universal Mobil Communications System (UMTS) and WLAN in different licensed or unlicensed bands.

The receiver antenna represents an important part of any communication system. The antenna dimensions are inverse proportional with the frequency. As the frequency becomes larger the optimal antenna becomes smaller. For multiple communication protocols, spread over various frequency bands, using a single antenna becomes a challenging task.

The trend in the wireless mobile industry is to aggregate multiple communication protocols in a single device. With the new Digital Signal Processors (DSP) capable of executing over 10 billion instructions per second, currently it is possible to run multiple communication protocol on the same platform. In Software Defined Radios (SDR), the same processor is able to run different base band communication protocols. The real challenge is the antenna and the Radio Frequency (RF) front end. Each communication protocol requires a different antenna and a different RF front end raising cost and real estate issues.

One composite antenna structure which operates in multiple frequency bands is disclosed in U.S. patent application Ser. No. 10/859,169 filed Jun. 3, 2004 for "Modified Printed Dipole Antennas For Wireless Multi-band Communication System" by Emanoil Surducan, Daniel Iancu, and John Glossner. Those multi-band antennas are designed for WLAN dual frequency bands of, approximately 2.4 GHz and 5.2 GHz, and GSM and for 3G multi-band wireless communication devices, of approximately 0.824-0.960 GHz, 1.710-1.990 GHz and 1.885-2.200 GHz.

The effort to miniaturize the antenna and add more frequency bands to an existing antenna structure is not trivial. As the dielectric constant increases, the antenna will concentrate more energy resulting in less bandwidth and lower efficiency. To add more frequency bands meta materials are used on the ground plain in a periodic structure as reported in Alexander A. Zharov, Ilya V. Shadrivov, and Yuri S. Kivshar "Nonlinear Properties of left-handed Metamaterials," *Phys. Rev. Lett.* 18, July 2003, 91:3, pp 37401-1 to 4. A combination of composite magneto-dielectric substrate is used to increase the bandwidth and efficiency as described in Hosein Mosallaci, Kamal Sarabandi, "Engineered meta-substrates for antenna miniaturization"—Proceeding of URSI EMTS 2004, Vol. 1, pp. 191-193, Pisa, Italy.

An antenna with low reluctance material positioned to influence radiation pattern is described in U.S. Pat. No. 5,982,335. An antenna system with active spatial filtering surface is described in U.S. Pat. No. 6,806,843. A planar receiving TV antenna with broadband is described in U.S. Pat. No. 4,860,019.

The miniature micro-strip composite multi-band antenna of the present disclosure allows the reception of various signals in different frequency bands with a single antenna. The composite antenna is shown as constructed as a microstrip dipole antenna with a shorted antenna placed in the near field. The technique is applicable for communication protocols at any frequencies. As an example, the present multi-band antenna structure adds more received frequency bands to the UMCS bands and, especially at low frequencies, 100 to 1000 MHz. It also exhibits increased gain in these bands.

The multi-band antenna structure includes a first antenna having a first band width about a first middle frequency and a second antenna spaced and electrically isolated from the first antenna. Ends of the second antenna are shorted to each other and the second antenna floats electrically. The first and second antennas are planar and superimposed in parallel planes. At least first and second layers of dielectric material of a first and second thickness respectively are between the two antennas. A third layer of dielectric material of a third thickness is between the two antennas.

The total thickness of the three layers is less than the quarter wave length of the lowest middle frequency. The first thickness of the first layer adjacent the first antenna is greater than the third thickness of the third layer adjacent the second antenna, and the first and third layers have the same permittivity. The second thickness of the second layer between the first and third layers is greater than the first thickness of the first layer, and the second layer has a low permittivity than the first and third layers.

The antenna structure has at least one band with a middle frequency below 1 gigahertz and an S11 of less than −10 dB and VSWR of less than 2. Alternatively, the antenna structure has at least one band with a middle frequency below 2 gigahertz and an S11 of less than −10 dB and VSWR of less than 2, and at least two band with a middle frequency above 2 gigahertz and an S11 of less than −10 dB and VSWR of less than 2.

The first antenna may include a matching circuit connected between a feed terminal, a ground terminal and the antenna. The antenna structure may include an electrically floating split ring resonator spaced from the first and second antennas. The second antenna and the resonator are in a common plane which is parallel to a plane of the first antenna.

These and other aspects of the present disclosure will become apparent from the following detailed description of the disclosure, when considered in conjunction with accompanying drawings.

A DETAILED DESCRIPTION OF THE DRAWINGS

Figure 1:
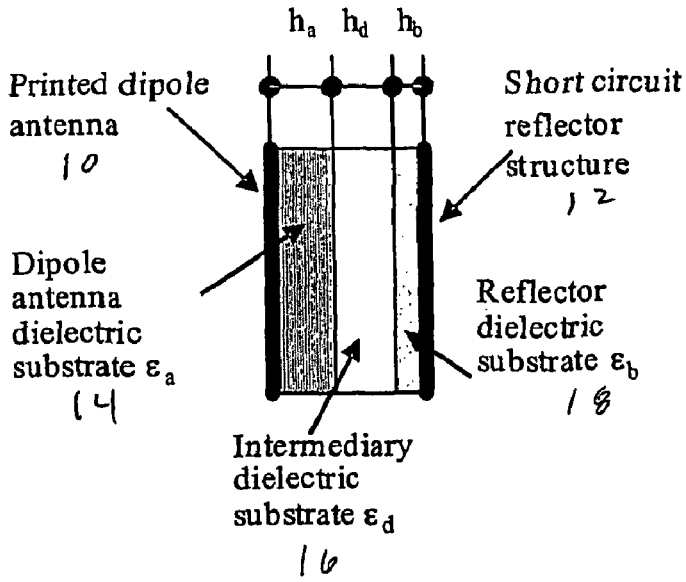
FIG. 1 is a side view of an antenna according to the present disclosure.

An example of the multi band antenna structure according to the present disclosure is illustrated in FIG. 1. It includes a first active antenna 10 separated from a shorted antenna 12 by dielectric substrates 14, 16 and 18.

The dielectric substrate 14 of the active antenna 10 has the same value for the permittivity as the shorted antenna dielectric substrate 18 but the heights are different.

$$\in_{ra}=\in_{rb} h_b<h_a$$

The intermediary dielectric substrate 16 has the relative dielectric permittivity value $\in_{rd}$ between 1 and 2.5 for example. The total height of the composite antenna must be less than the quarter wave length of the middle frequency of the lowest frequency band:

$$h_a+h_b+h_d<\lambda/4$$

As an example, possible values are: $\in_a=\in_b=4.89$; ∈d=1.012; ha=1.6 mm; hb=0.5 mm, HD=2.2 mm. An example of the dielectric substrates are ceramic-PTFE composite (as RT/duroid 6006/6010LM), alumina ceramic (Al2O3), and ceramic filled PTFE (FR-4, Rogers TMM-4), for ∈a and ∈b, and glass micro-fiber reinforced PTFE composite, TEFLON, honeycomb material, air, polistyren for ∈d The basic idea of the composite antenna design is to use a shorted antenna 12 in the near field location of the active antenna 10. This is based on the properties of the Electromagnetic wave (EM) reflection on objects in the free space. To be more specific, a dimensionless object is considered to be an ideal antenna. The antenna is assumed to have certain gain in a specific frequency band Δf. When the electromagnetic wave of frequency $f_0$, (where $f_0$ belongs to Δf) interacts with the ideal antenna, the reflected EM wave will exhibit:

1. Zero energy when the antenna is connected to an open circuit. If a voltage probe is placed in the vicinity of the antenna, the measured voltage will be zero, i.e. $\Delta U_{open}=0$ and, does not depend on the probe position.
2. Progressive wave when the antenna is connected to a matched load. The antenna reflects as much as it absorbs, the detected voltage will be $\Delta U_{prog}=U$. In a glossy environment, U decreases as the distance to the antenna increases.
3. Standing wave, if antenna is connected to a short circuit. Antenna reflects as much as it absorbs but the maximum voltage detected by a probe will be $\Delta U_{stand}=U^2$. The voltage detected by a probe will be a squared sinusoidal function with the distance to the antenna ($Umax=U^2$ *and* Umin=0). The maxim value is attained at a distance off λ/4 from the antenna, where λ is the middle band of frequency (Δf) wavelength and $$\Delta U=U_{with\ antenna}-U_{without\ antenna}$$

In the previous equation, ΔU has the significance of the voltage detected by a probe in the free space with and without an antenna.

Figure 2:
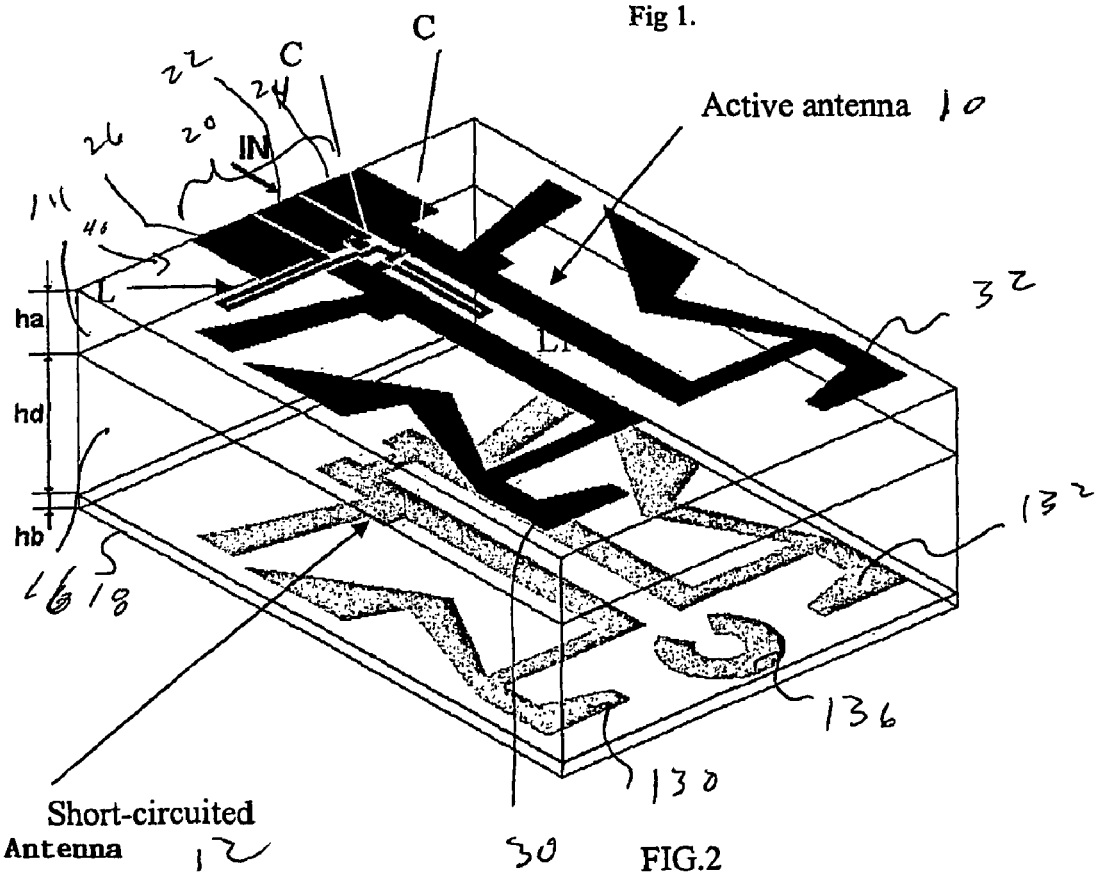
FIG. 2 is a perspective see-through drawing of a composite antenna according to the present disclosure.
Figure 3:
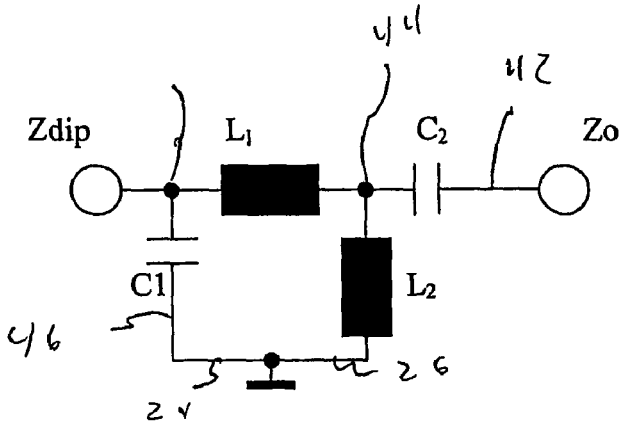
FIG. 3 is an electrical schematic of a matching circuit of FIG. 2.
Figure 4:
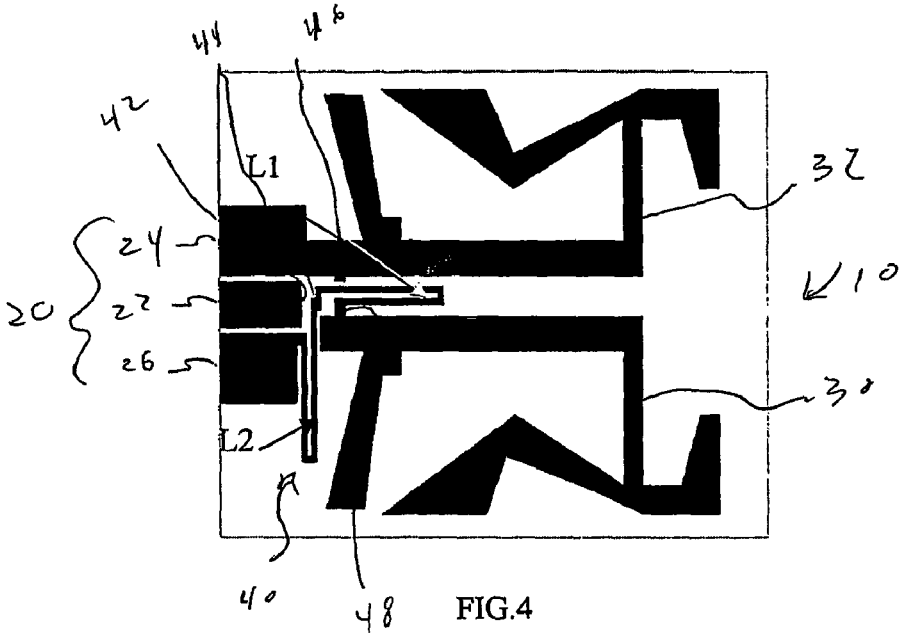
FIG. 4 is a plan view of the active or first antenna portion of FIG. 2.
Figure 5:
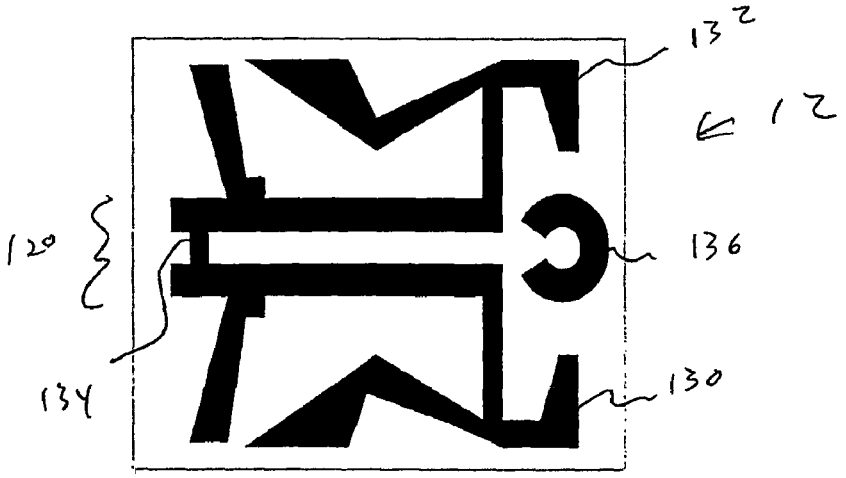
FIG. 5 is a plan view of the second antenna of FIG. 2.

An example of the composite antenna according to the present disclosure is illustrated in FIGS. 2, 4 and 5. An example of an active dipole antenna 10 included legs 30 and 32 and has an excitation point 20 illustrated as a coaxial excitation connection. The center feed is terminal 22 and the grounding inputs are terminals 24 and 26. The excitation point 20 is connected through a matching circuit 40 to the dipole legs 30 and 32. A schematic of the excitation circuit 40 is illustrated in FIG. 3.

As shown in FIGS. 2, 3 and 4, the matching circuit includes a capacitor C2 connected between pad 42 of input or feed terminal 22 and the connection 44 of inductive strips L1 and L2. The other end of L2 is connected to terminal 26 which is connected to ground and the other side of L1 is connected at pad 48 to leg 30 of the dipole antenna 10. A second capacitor C1 is connected to the pad 48 of leg 30 and pad 46 of leg 32 of the antenna 10. The other end of capacitor C1 and 46 is connected to terminal 24 of the excitation point 20 which is also connected to ground. Whereas the inductors L1 and L2 are printed on the same layer as the antenna as legs 30 and 32 of the antenna 10, the capacitor C1 and C2 are sodered onto pads 42, 44, 46 and 48 respectively. Zo represents the line impedance and Zdip the impedance of the printed dipole 10. An example of the matching circuit component have the following values:

Zdip=240 ohm, Zo=50 ohm, $L_1=L_2=23$ nH, C1=1 pF, $C_2=4$ pF

The second antenna 12 has approximately the same geometric configuration as the active antenna 10, except that the excitation point is shorted out.

As specifically shown in FIG. 5, the shorted antenna 12 has a dipole antenna configuration including legs 130 and 132. The excitation point 120 is short circuited by element 134. In addition to the structure which is the same as that of antenna 10, there is a split ring resonator 136 provided between the legs 130 and 132 of shorted antenna 12. The shorted antenna 12 is not connected to ground and this is electrically floating and electrically isolated from antenna 10.

Although the antenna 10 and the shorted antenna 12 were designed for DVB frequency bands, other bands or configurations may be used. The same principle of that of the present system will work. Also, other antenna structures may be used, for example printed dipole or monopole antennas, wire dipole or monopole antennas, omni-directional antennas, microstrip patch, small telescopic antennas and dielectric antennas.

Figure 6:
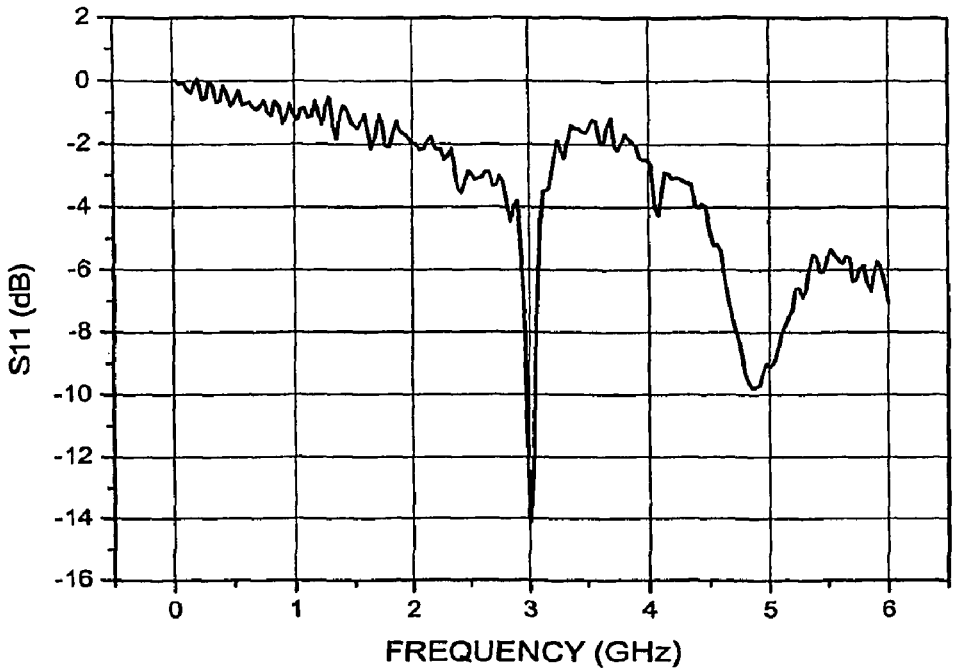
FIG. 6 is a graph of frequency versus a gain of S11 for the active antenna in combination with the matching circuit.
Figure 7:
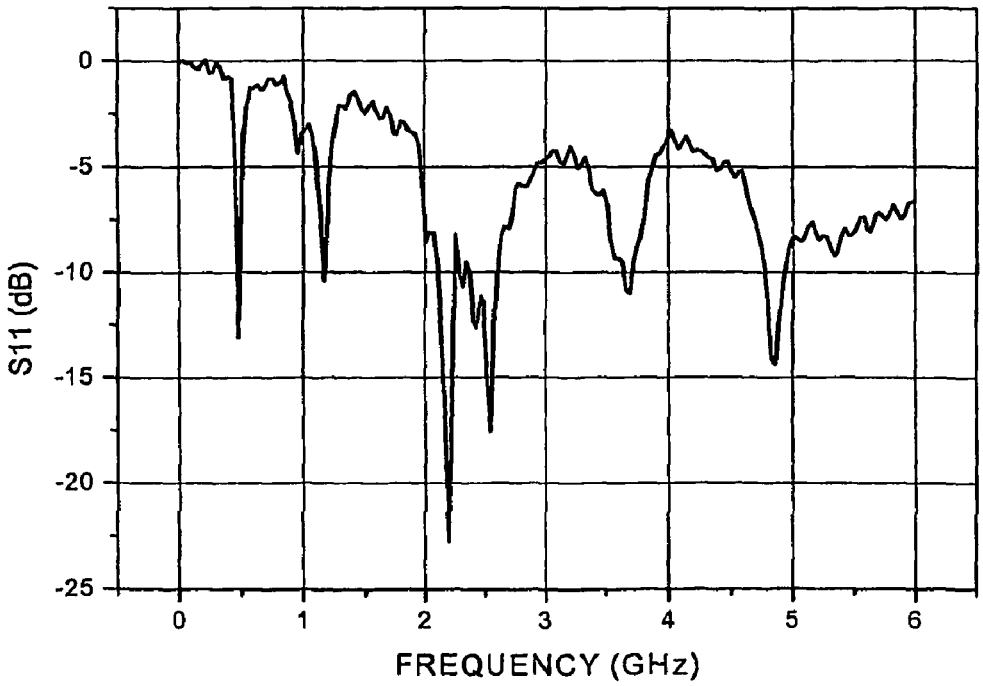
FIG. 7 is a graph of frequency versus a gain of S11 for the composite antenna of FIG. 2.

Comparison of the operation of the antenna 10 as a stand alone antenna versus the composite antenna including antenna 10 and the shorted antenna 12 will be illustrated with respect to FIGS. 6 and 7. The antenna 10 with the matching circuit 40 produced the gain in S11 versus frequency illustrated in FIG. 6. The structure resulted in two frequency bands at approximately 3 gigahertz and just less than 5 gigahertz. With the addition of the two additional dielectric substrates 16 and 18 and the shorted antenna 12 the characteristics for the gain of S11 versus frequency of FIG. 7 resulted. Instead of having only two frequency bands, a variety of other bands appear centered at different frequencies. It can also be seen that the initial bands have moved from their initial positions. Combing the simulation and measurement technique, the additional bands can be tuned to be positioned at the desired frequencies as required by specific communication systems.

The composite antenna as shown has the following frequency bands at VSWR<2: 470-490 MHz, 1.16-1.175 GHz, 2.1-2.6 GHz, 3.64-3.7 GHz and 4.78-4.91 GHz. In this particular design, the antenna was not fine tuned to the required frequencies. It also can be seen that there is a lower frequency band specific to the TV channels.

With the present design, it is possible to make miniature antenna for lower frequencies comparative to the antennas of higher frequencies. For example, the experimental antenna presented here has overall dimension (41×57×4.4) mm, comparative to $\lambda_{500\ MHz}=660$ mm. This procedure to obtain a composite antenna can be used to improve the characteristic of an existing antenna by adding the additionally dielectric and short-circuited antenna layer. The short-circuited antenna can have any geometrical shape with the condition to have the S11<−10 dB over desired frequency. The composite antenna can be made not only using a printed dipole as active antenna; it can be used as active antenna a wire dipole or any miniature antenna.

The present antenna system can be designed for WLAN dual frequency bands of, approximately 2.4 GHz and 5.2 GHz, GSM and 3G multi-band wireless communication devices, of approximately 0.824-0.960 GHz, 1.710-1.990

GHz and 1.885-2.200 GHz, GPS (1.575 GHz) or Blue Tooth Specification (2.4-2.5 GHz) frequency ranges, for example.

Although the present disclosure has been described and illustrated in detail, it is to be clearly understood that this is done by way of illustration and example only and is not to be taken by way of limitation. The scope of the present disclosure is to be limited only by the terms of the appended claims.

What is claimed:

1. A multi-band antenna structure comprising:

a first antenna having a first band width about a first middle frequency;

a second antenna spaced and electrically isolated from the first antenna; and an electrically floating split ring resonator spaced apart from the first and second antennas, wherein, ends of the second antenna are shorted to each other and the second antenna floats electrically, and wherein the antenna structure has a plurality of bandwidths each about a respective middle frequency of the antenna structure.

2. The antenna structure of claim 1, wherein the first and second antennas are planar and superimposed upon one another in parallel planes.

3. The antenna structure of claim 2, including at least first and second layers of dielectric material of a first and second thickness respectively disposed between the two antennas.

4. The antenna structure of claim 3, including a third layer of dielectric material of a third thickness disposed between the two antennas.

5. The antenna structure of claim 4, wherein the total thickness of the three layers of dielectric material is less than the quarter wavelength of a lowest middle frequency of the antenna structure.

6. The antenna structure of claim 4, wherein the first thickness of the first layer adjacent the first antenna is greater than the third thickness of the third layer adjacent the second antenna, and the first and third layers have the same permittivity.

7. The antenna structure of claim 6, wherein the second thickness of the second layer between the first and third layers is greater than the first thickness of the first layer, and the second layer has a low lower permittivity than that of the first and third layers.

8. The antenna structure of claim 1, wherein the antenna structure has at least one band with a middle frequency that is below 2 gigahertz and a return loss that is less than −10 dB.

9. The antenna structure of claim 1, wherein the antenna structure has at least one band with a middle frequency that is below 1 gigahertz and a return loss that is less than −10 dB and a VSWR that is less than 2.

10. The antenna structure of claim 1, wherein the antenna structure has at least one band with a middle frequency that is below 2 gigahertz and an S11 that is less than −10 dB and a VSWR that is less than 2, and at least two bands each have a middle frequency that is above 2 gigahertz and a return loss that is less than −10 dB and a VSWR that is less than 2.

11. The antenna structure of claim 1, wherein the first and second antennas have the same geometric configuration.

12. The antenna structure of claim 1, further comprising a matching circuit that is connected to the first antenna feed point between a feed terminal, a ground terminal and the first antenna.

13. The antenna structure of claim 1, wherein the first and second antennas are printed dipoles or monopoles, wire dipoles or monopoles, omni-directional microstrip patches, small telescopic antennas or dielectric antennas.

14. The antenna structure of claim 1, wherein the second antenna and the resonator are in a common plane, which is parallel to a plane of the first antenna.

15. The antenna structure of claim 1, wherein the first and second antennas are separated by a plurality of dielectric layers, and wherein at least two of the dielectric layers have the same permittivity and another dielectric layer has permittivity that is lower than the at least two others.

16. A multi-band antenna structure comprising:

a first antenna having a matching circuit connected to feeding points of the first antenna;

a second antenna spaced and electrically isolated from the first antenna and having a load connected to a feeding point of the second antenna; and an electrically floating split ring resonator spaced apart from the first and second antennas, wherein, the second antenna floats electrically, and wherein the antenna structure operates at a plurality of bandwidths and working band frequencies are selectable based on feeding point positions relative to a respective antenna length as well as impedance load values in both the first and second antennas.

17. The multi-band antenna of claim 16, further comprising at least first, second and third layers of dielectric material of a first, second and third thickness respectively disposed between the two antennas.

18. The multi-band antenna of claim 16, wherein a total thickness of the three layers of dielectric material is less than the quarter wavelength of a lowest middle frequency of the antenna structure.

19. The multi-band antenna of claim 18, wherein the first thickness of the first layer adjacent the first antenna is greater than the third thickness of the third layer adjacent the second antenna, and the first and third layers have the same permittivity.

20. The multi-band antenna of claim 16, wherein the first and second antennas are separated by a plurality of dielectric layers, and wherein at least two of the dielectric layers have the same permittivity and another dielectric layer has permittivity that is lower than the at least two others.

* * * * *